United States Patent [19]

Trozzi

[11] 4,043,512

[45] Aug. 23, 1977

[54] COAL BURNER

[75] Inventor: Norman K. Trozzi, West Caldwell, N.J.

[73] Assignee: Foster Wheeler Energy Corporation, Livingston, N.J.

[21] Appl. No.: 651,866

[22] Filed: Jan. 23, 1976

[51] Int. Cl.[2] ..... B05B 7/10

[52] U.S. Cl. ..... 239/402.5; 239/406; 239/468; 431/173

[58] Field of Search ..... 239/403, 402.5, 587, 239/468, 405, 406; 431/173, 185

[56] References Cited

U.S. PATENT DOCUMENTS

| | | | |
|---|---|---|---|
| 2,351,697 | 6/1944 | Nielsen | 239/406 X |
| 3,240,433 | 3/1966 | Keating | 239/405 X |
| 3,436,068 | 4/1969 | Beals et al. | 239/587 X |
| 3,469,790 | 9/1969 | Duncan | 239/402.5 |
| 3,550,859 | 12/1970 | Pettit | 239/468 |
| 3,645,452 | 2/1972 | Stoeckel et al. | 239/227 |

*Primary Examiner*—Evon C. Blunk
*Assistant Examiner*—Michael Mar
*Attorney, Agent, or Firm*—Marvin A. Naigur; John E. Wilson

[57] ABSTRACT

A burner for use in a vapor generator having an outlet feeding the combustion zone of the generator with a mixture of fuel and air in a controlled turbulent flow. The housing for the burner has a relatively small diameter so that a relatively small amount of primary air is sufficient to carry the fuel to the burner nozzle. At least one atomizer is fitted in an opening of the burner housing for introducing atomizing air in a generally tangential direction relative to the axial flow of the fuel. The air creates turbulence so as to swirl the fuel and distribute same in a controlled manner to provide for even burning of the fuel in the combustion zone.

6 Claims, 7 Drawing Figures

COAL BURNER

BACKGROUND OF THE INVENTION

A number of designs are presently available which provide for distribution of pulverized fossil fuel, such as coal to the combustion zone of a furnace. In a great majority of these designs a fuel carrying conduit receives pulverized fuel from an external source and is connected to a burner for distributing the fuel to the burner. Both the conduit and the burner are relatively large in diameter and include a device for creating turbulence to enable the pulverized fuel to be distributed in a controlled manner so that it will burn more evenly in the combustion zone.

Since the coal fired burners described above are relatively large in diameter, a correspondingly large amount of primary air is required to deliver the fuel to the combustion zone which tends to create combustion limitations, especially under conditions calling for low furnace load.

Also, coal fired burners presently in use have a physical construction which is cumbersome and expensive to fabricate since their diameters can range from about one foot to over two feet, and are more or less fixed in position. Due to this size, adjustment is very limited and in most cases none is possible once the apparatus is installed in situ. Furthermore, repairs requiring removal of the burner are difficult to accomplish for the same reason.

On the other hand, gas and oil fired burners have relatively small fuel lines and atomizers, which are relatively easy to adjust both in regard to the positioning within openings in the boiler walls and with respect to fuel flow regulation under different load conditions. For example, gas and oil fired burners can be controlled so as to provide sufficient fuel for as low as about 20–25% full burner load rating, whereas coal fired burners have less flexibility and may only be decreased to about 40–50% of full load before the burner must be removed from service.

SUMMARY OF THE INVENTION

It is therefore an object of the present invention to eliminate some of the problems normally associated with coal fired burners and, more particularly to provide a coal fired burner having characteristics which approach those of a gas and oil fired burner.

Toward the fulfillment of these and other objects, the burner of the present invention is designed to feed the combustion zone of a vapor generator with a mixture of pulverized fuel and air in a controlled turbulent flow. The burner includes a housing with an inlet for receiving the fuel and an outlet communicating with the combustion zone. The housing has a relatively small cross-sectional area, such that a relatively small amount of primary air is necessary to carry the fuel axially through the nozzle. At least one atomizing means is fitted into an opening of the housing for introducing a controlled stream of air in a generally tangential direction relative to the axial flow of the fuel through the housing for creating turbulence so as to swirl the fuel and distribute same in a controlled manner. The energy of the atomizing air creates the necessary turbulence to provide for even burning of the fuel in the combustion zone.

BRIEF DESCRIPTION OF THE DRAWINGS

The above description, as well as further objects, features and advantages of the present invention will be more fully appreciated by reference to the following description of presently preferred but nonetheless illustrative embodiments in accordance with the present invention, when taken in connection with the accompanying drawings wherein.

DESCRIPTION OF THE PREFERRED EMBODIMENTS

Figure 1:
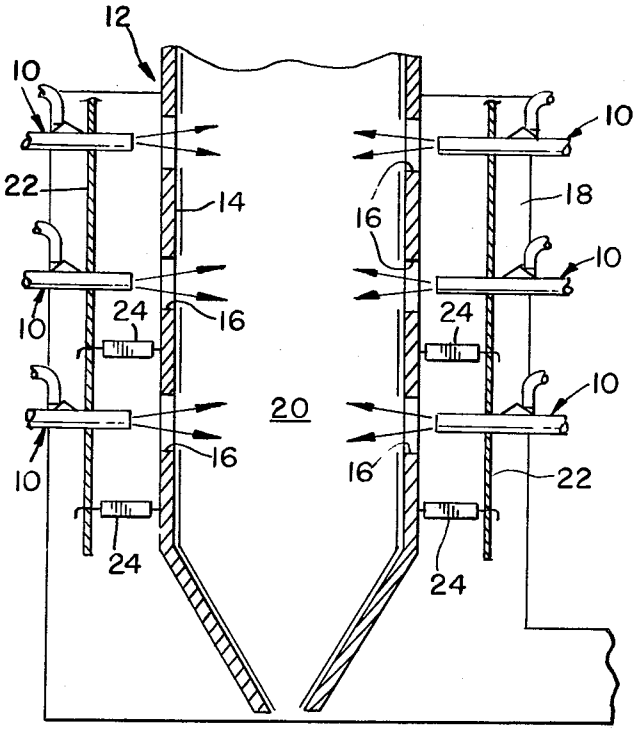
FIG. 1 is a partial elevational view of a vapor generator with its boiler walls shown in cross section and including the burners of the present invention.

In FIG. 1 the reference numeral 10 refers in general to the burners of the present invention shown installed in a boiler section 12 of a vapor generator and having wall sections 14 and openings 16 extending therethrough. The burners 10 are mounted within a windbox 18 enclosing the lower portion of the boiler section 12 and the burners discharge through the openings 16 into a combustion zone 20 in the interior of the boiler section as indicated by the flow arrows. A register 22 is formed within windbox 18 having dampers 24 for regulating the flow of secondary air to the interior of the boiler 12, in a conventional manner.

Figure 2:
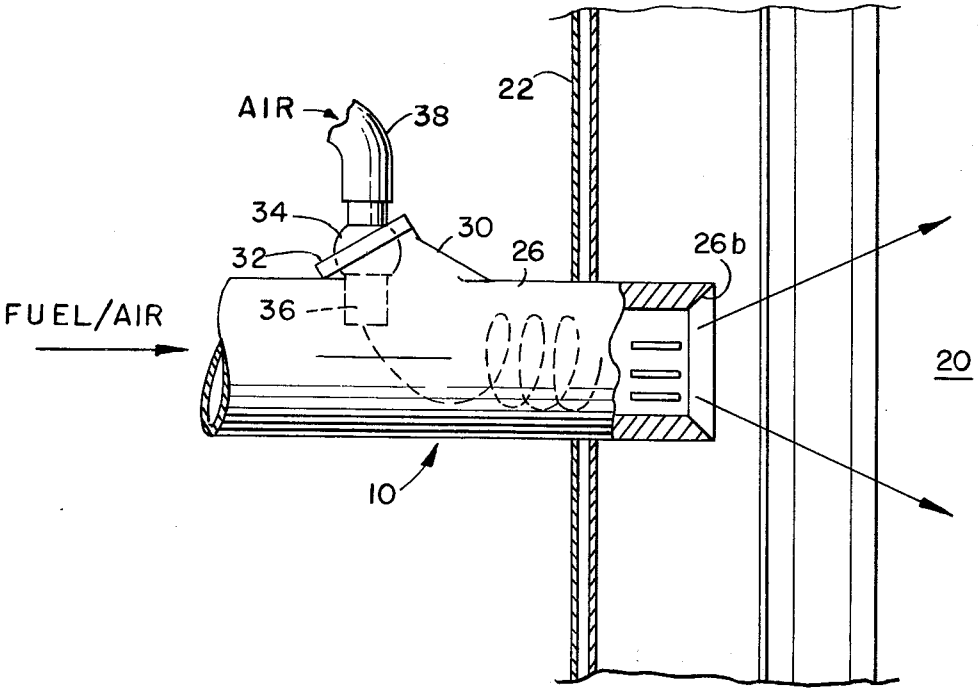
FIG. 2 is an enlarged partial elevational, partial sectional view depicting a section of the vapor generator of FIG. 1 and in particular, a burner according to the present invention.
Figure 4:
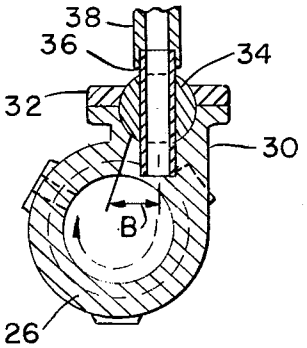
FIG. 4 is a cross-sectional view taken along the line 4—4 of FIG. 3.
Figure 3:
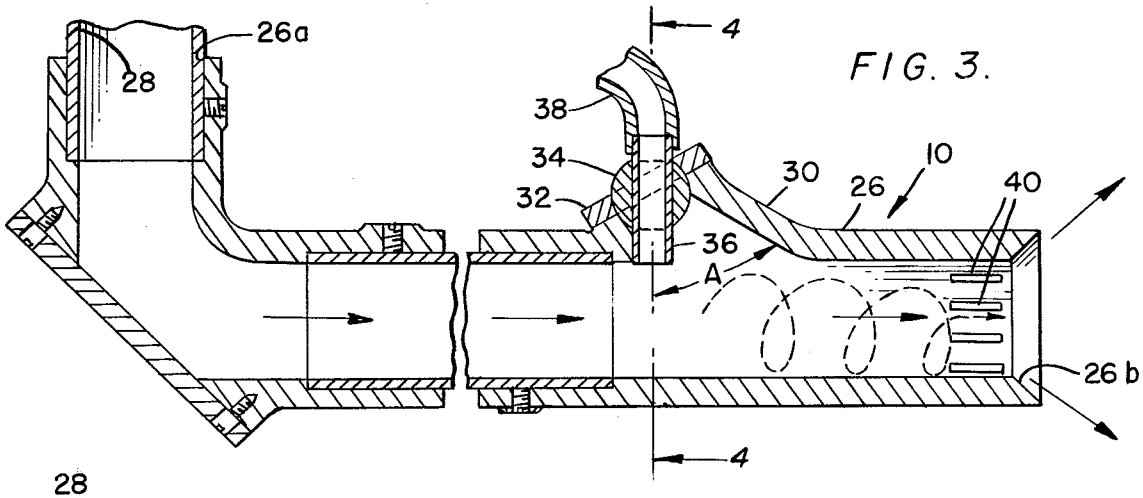
FIG. 3 is an enlarged cross-sectional view of the burner of FIG. 2.

Referring to FIGS. 2–4, each burner 10 includes a cylindrical housing 26 having an inlet **26*a* (FIG. 3) for receiving a fuel-air mixture from a supply line 28, and an outlet 26*b* for discharging the mixture after the mixture has passed through the length of the housing as indicated by the solid flow arrows in FIGS. 2 and 3. The wall of the housing 26 has an angularly extending cylindrical boss 30 formed thereon which communicates with the interior of the housing 26. A cap 32 extends over the boss 30 and has an opening extending therethrough which receives a moveable ball joint 34. A tubular atomizer 36 extends through an opening in the ball joint 34 with its axis extending substantially tangential to the inner wall of the housing 26 in the position shown in FIG. 4. One end of the atomizer 36 registers with the interior of the housing 26 and a supply line 38** for pressurized air is connected to the other end of the atomizer.

As a result, air from the line 38 passes through the ball joint 34 and the atomizer 36, from which it discharges into the interior of the housing 26 in a tangential direction relative to the inner wall thereof, as shown by the dashed flow lines in FIGS. 2 and 3. The air thus imparts a centrifugal swirl to the fuel-air mixture flowing axially through the housing which enables a controlled turbulence to be achieved with a minimal amount of air. As a result, the mixture of air and fuel discharges outwardly from the outlet 26*b* to the primary combustion zone 20 in a substantially conical shaped discharge pattern.

It is noted from a view of FIGS. 3 and 4 that the ball joint 34 permits angular adjustment of the atomizer 36 from a vertical line coinciding with the axis of the atomizer 36 in a vertical position of the latter as shown in the drawings and extending perpendicular to the axis of the housing 26. This angular adjustment can be made in two orthogonal planes as shown by the angles A and B in FIGS. 3 and 4, respectively, which angles can be varied from 0° to approximately 45°. This adjustment enables the degree and type of swirl, and resultant turbulence at the combustion zone, to be varied according to the particular design requirements.

As a result of the foregoing, the mixture of fuel and air discharging from the burner 10 is quite rich and reductions in fuel for decreasing load conditions do not affect the flow and burning characteristics of the mixture as radically as with conventional systems which carry relatively large amounts of primary air.

The discharge of the mixture of fuel and air from the outlet 26*b* of the burner 16 may also be controlled by a plurality of axially extending bars 40 mounted on the inner wall of the housing 26 near the outlet 26*b.* The bars 40 tend to collect streams of fuel in radial positions circumferentially about the inner wall of the housing 26. The use of bars 40 are optional since they may be required only in certain applications.

Figure 6:
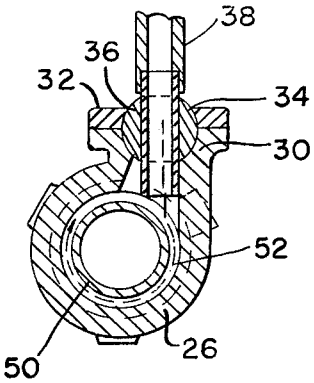
FIG. 6 is a cross-sectional view taken along line 6—6 of FIG. 5.
Figure 5:
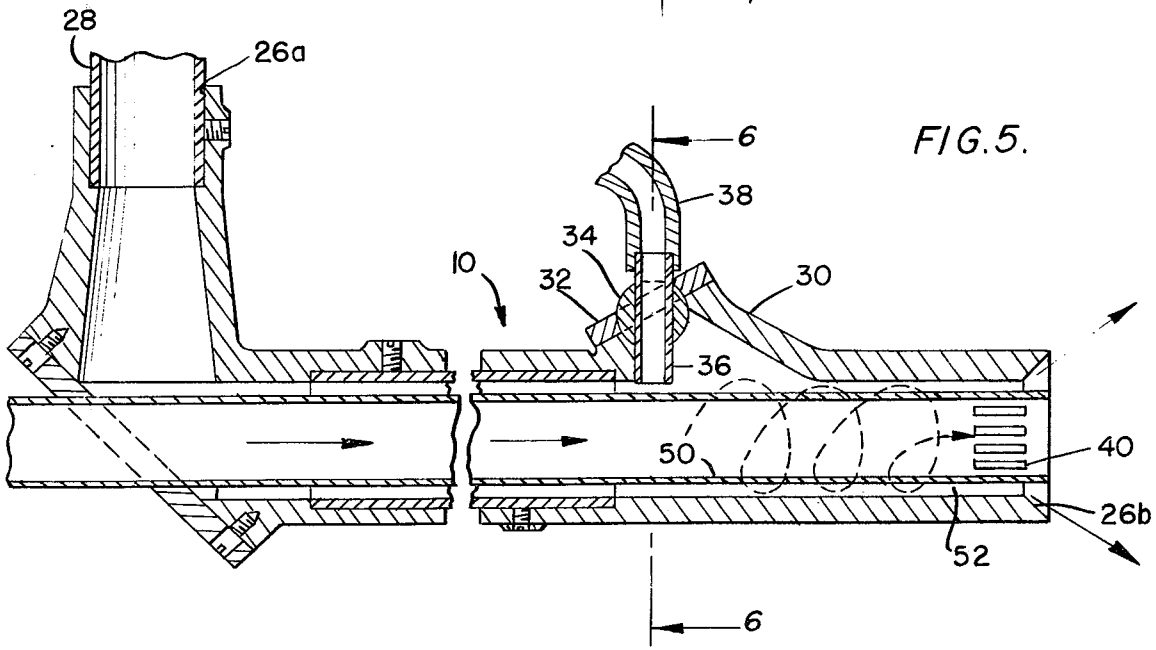
FIG. 5 is a view similar to FIG. 3, but depicting another embodiment of the burner of the present invention.

In FIGS. 5 and 6 the burner 10 is shown in use with an oil, gas or oil/gas feed tube 50 which is coaxially mounted within the housing 26 and extends from a point upstream of the fossil fuel inlet 26*a* which is inoperative in this embodiment. The outer diameter of the tube 50 is less than the inner diameter of the housing 26 to define an annular space 52 therebetween. One end of the tube 50 extends flush with the outlet 26*b* of the housing 26 and the other end of the tube 50 is adapted for connection to a source (not shown) of oil, gas, or combination thereof, as well as a source of air.

According to the embodiment of FIGS. 5 and 6 swirling air from the atomizer 36 is introduced into the annular space 52 as in the previous embodiment, and flows to the outlet 26*b* of the housing 26 where it mixes with the rich mixture of fuel and primary air from the discharge end of the tube 50 at the combustion zone. As in the previous embodiment, the air from the atomizer 36 creates a centrifugal swirl which results in a controlled turbulence in the combustion zone.

The burner 10 shown in FIGS. 1–6 of the present invention is sized to be of similar size as those for conventional oil and gas burners. For example, the housing 26 of FIGS. 1–4 may have an inner diameter as small as 4 inches while, in FIGS. 5 and 6, it may have an inner diameter of approximately 5 or 6 inches. In the latter arrangement, the inner diameter of the feed tube 50 may be about four inches with the annular space 52 being about 1 to 2 inches. In both embodiments, the horizontal distance from the atomizer 36 to the outlet 26*b* may be in the order of 1–5 times the inner diameter of the housing 26.

Figure 7:
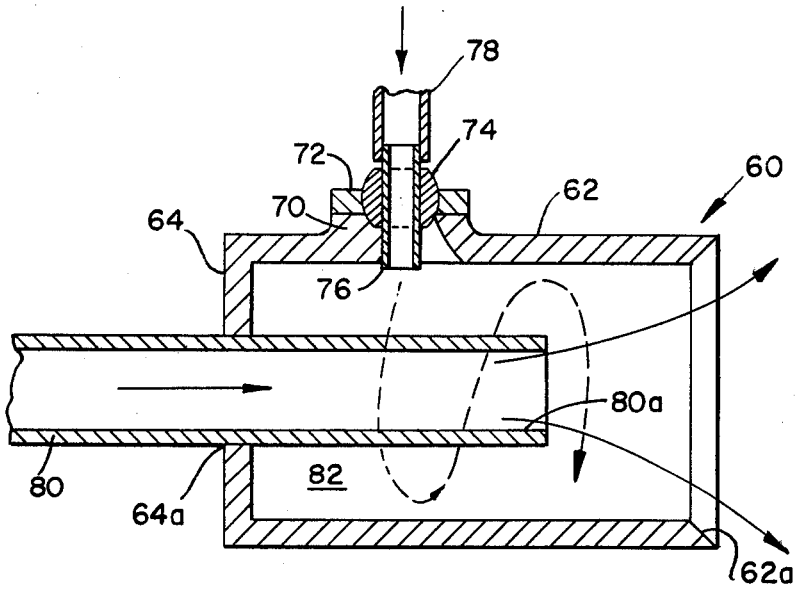
FIG. 7 is a view similar to FIGS. 3 and 5, but depicting another embodiment of the present invention.

Referring to the embodiment of FIG. 7, a burner 60 is depicted which includes a cylindrical housing 62 having one open end portion defining an outlet 62*a* and a rear face portion 64 defining an opening 64*a.* A cylindrical boss 70 is formed on the outer wall portion of the housing 62 extending perpendicular to the axis thereof, and communicates with the interior of the housing. A cap 72 extends over the boss 70 and has an opening extending therethrough which receives a moveable ball joint 74. A tubular atomizer 76 extends through an opening formed in the ball joint 74 with one end of the atomizer registering with the interior of the housing 62. A supply line 78 for pressurized fluid such as air is connected to the other end of the atomizer 76. Although not clear from FIG. 7, it is understood that the boss 70, and therefore the ball joint 74 and the atomizer 76 are offset relative to the central plane of the housing 62, resulting in the axis of the atomizer 76, in its vertical position, extending substantially tangential to the inner wall of the housing 62 as in the previous embodiment. Therefore, air or other fluid from the line 78 passes through the ball joint 74 and the atomizer 76, and discharges in a tangential direction relative to the inner wall of the housing 62 as shown by the dashed flow arrows in FIG. 7.

A feed tube 80 extends through the opening 64*a* in the rear face 64 of the housing 62 and has an inlet portion (not shown) which is connected to sources of air and fuel in fluid form such as oil or gas. The tube 80 defines a discharge outlet 80*a* which is located within the interior of the housing 62 and is spaced inwardly from the discharge outlet 62*a.* The outer diameter of the feed tube 80 is less than the inner diameter of the housing 62 so as to define an annular space 82 therebetween.

In operation, the atomizing air is introduced through the atomizer 76 and into the interior of the housing 62 where it creates a circular air pattern within the annular space 82, as in the previous embodiment. The resulting turbulence acts to spread out, or fan, the flow of the mixture of liquid fuel and air discharging from the outlet 80*a* of the feed tube 80 in a substantially conical pattern as in the previous embodiment. It is noted that in the embodiment of FIG. 7, the discharging fuel from the tube 80 travels a short distance within the housing 62 from the outlet 80*a* to the outlet 62*a* before it discharges through the latter in a conical pattern.

According to a preferred embodiment, the distance from the outlet 80*a* of the feed tube 80 to the outlet 62*a* of the housing 62 can vary from between 0.5 – 2.0 times the inner diameter of the feed tube 80. Also, the distance from the outlet 80*a* of the feed tube 80 to the end plate 64 of the housing 62 can vary from approximately 0.5 – 3.0 times the inner diameter of the feed tube 80. The distance between the inner wall of the housing 62 and the outer wall of the feed tube 80 can vary from approximately 0.5 – 3.0 inches while the distance from the central axis of the atomizer 76 to the outlet 62*a* of the housing 62 can vary from approximately 1.0 – 5.0 times the inner diameter of the feed tube 80.

It can be appreciated that, by virtue of its relatively small size, the burner of each of the foregoing embodiments of the present invention provides a distinct improvement over conventional burners that have a diameter between one and two feet, for reasons set forth above.

It is understood that several variations may be made in the foregoing without departing from the scope of the invention. For example, the fluid discharged through the atomizers depicted in the above embodiments is not limited to air but may be another fluid such as flue gas or the like. Also, it is understood that the angular adjustments of the respective atomizers may be made by means other than the ball joints depicted.

Also, although not particularly illustrated in the drawings, it is understood that the air pressure in the lines connected to the atomizer may be regulated in order to compensate for changing loads and desired flow patterns as required. For example, a stronger atomizing air pressure may be required if a particular rich mixture of fuel is utilized under heavy load conditions. Finally, in each of the foregoing embodiments, additional atomizers may be added to the system as necessary. For example, opposed tangential atomizers may be disposed around the periphery of the housings so as to increase the tangential flow of air in the nozzle to increase the attendant turbulence.

As a result of the foregoing, the primary air flow into the combustion zone of the boiler is modified so that a reduced volume thereof may be introduced thus reducing the formations of nitric oxides. As a result, something less than the required stoichiometric fuel air mixture may be utilized to prevent an inordinate generation of noxious gases. As a direct beneficial result, the relative sizes of the burners can be reduced.

Of course, variations of the specific construction and arrangement of the method disclosed above can be made by those skilled in the art without departing from the invention as defined in the appended claims.

What is claimed is:

1. A burner comprising:

a cylindrical housing for receiving fuel and having an outlet for discharging said fuel;

a tube disposed upstream of said outlet and extending through a wall of said housing, said tube having one end connected to a source of combustion-supporting fluid and the other end communicating with the interior of said housing for discharging said fluid in a direction substantially tangential to the inner wall of said housing, said fluid imparting a swirl to the fuel discharging from said outlet; and support means for adjustably mounting said tube relative to the wall of said housing for movement of said tube in two orthogonal planes, one of said planes being substantially parallel to the direction of fuel flow through said housing and the other of said planes being substantially perpendicular to the fuel flow direction.

2. The burner of claim 1, wherein said support means comprises a ball joint mounted in an opening in said housing and having an aperture extending therethrough for receiving said tube.

3. The burner of claim 1, wherein said fuel is in fluid form and further comprising a feed tube for receiving said fuel, said feed tube having an outlet for discharging said fuel, at least a portion of said feed tube extending coaxially within said housing and having its outer diameter spaced from the inner diameter of said housing to define an annular path for said combustion-supporting fluid.

4. The burner of claim 3, wherein the outlet of said feed tube extends flush with the outlet of said housing.

5. The burner of claim 3, wherein the outlet of said feed tube extends within said housing in a spaced relation to the outlet of said housing.

6. The burner of claim 3, wherein said support means comprises a ball joint in an opening in said housing and having an aperture extending therethrough for receiving said tube.

* * * * *